US007651370B2

(12) United States Patent
Chuang

(10) Patent No.: US 7,651,370 B2
(45) Date of Patent: Jan. 26, 2010

(54) MULTI-PORT CONNECTOR FOR INTEGRATING TRANSMISSION INTERFACES OF DISPLAYPORT AND USB

(76) Inventor: Yi-Fang Chuang, 5F., No. 15, Lane 117, Sec. 4, Sanhe Rd., Sanchong City, Taipei County 241 (TW)

( * ) Notice: Subject to any disclaimer, the term of this patent is extended or adjusted under 35 U.S.C. 154(b) by 0 days.

(21) Appl. No.: 11/877,854

(22) Filed: Oct. 24, 2007

(65) Prior Publication Data

US 2009/0029593 A1 Jan. 29, 2009

(30) Foreign Application Priority Data

Jul. 24, 2007 (TW) ..... 96212092 U

(51) Int. Cl.
*H01R 13/60* (2006.01)

(52) U.S. Cl. ..... 439/540.1; 439/607.01

(58) Field of Classification Search ..... 439/540.1, 439/541.5, 607

See application file for complete search history.

(56) References Cited

U.S. PATENT DOCUMENTS 6,540,563 B1 * 4/2003 Hu et al. ..... 439/676
6,755,685 B1 * 6/2004 Espenshade ..... 439/541.5
7,217,146 B2 * 5/2007 Meister et al. ..... 439/148
2004/0229502 A1 * 11/2004 Hu et al. ..... 439/541.5

* cited by examiner

*Primary Examiner*—Tho D Ta
*Assistant Examiner*—Travis Chambers
(74) *Attorney, Agent, or Firm*—Chun-Ming Shih

(57) ABSTRACT

A multi-port connector for integrating the transmission interfaces of DisplayPort and USB, includes a seat body, a DisplayPort, a USB connector, a sealing lid, and a hollow outer shell. At an upper portion of the seat body, there is a rabbet, under which a connecting trough is arranged. At back of the seat body, there is a recessing part, at upper portion of which an assembling opening is arranged, which is communicated to the rabbet. A plurality of fissures are arranged on a wall of the recessing part. The DisplayPort is assembled in the rabbet, while the USB connector is assembled in the connecting trough. The sealing lid is assembled and connected in the recessing part at back of the seat body. A bulger arranged at the sealing lid is assembled and connected in the assembling opening of the recessing part. On a wall surface of the sealing lid, there are a plurality of striping ribs, which are snapped into the fissures. The hollow outer shell externally fitted to the seat body is arranged a first perforation and a second perforation at front side face thereof. The first and second perforations respectively correspond to a plug-in opening and a USB slot, while a set of assembling-and-connecting legs are extended at a bottom side face of the hollow outer shell. The multi-port connector is to provide a plug-in function for the transmitting lines of the Displayport and the USB.

9 Claims, 5 Drawing Sheets

MULTI-PORT CONNECTOR FOR INTEGRATING TRANSMISSION INTERFACES OF DISPLAYPORT AND USB

BACKGROUND OF THE INVENTION

1. Field of the Invention

The present invention generally relates to a connector, in particular, to a multi-port connector for integrating transmission interfaces of DisplayPort and USB.

2. Description of Prior Art

Following a continuous progress of technology, there are many computer peripherals are manufactured successively. For example, in order to make computer able to be electrically connected with these peripherals of new generation, there are many connecting ports, with various specifications, arranged on a computer's motherboard, so that the computer may be electrically connected with the peripherals through various transmitting lines, making the computer able to output control signal or transmit data to the peripherals, or receive data transmitted back from the peripherals.

In recent years, the size of computer has a trend of miniaturization, so the volume of a computer's motherboard is shrunk as well. Under the conditions of a shrunk volume and a limited space of a motherboard, how to arrange a plurality of connecting ports with various specifications has become a challenging issue for the relative industry. According to the prior arts, as shown in FIG. 1, a printer's connecting port 200 is directly screwed at a supporting body 300, by which the connecting port 200 is overlapped to another or other connectors 200*a*, 200*b*, or it is possible to add slots to the connectors with same specification, for example, a USB connector 400 or a PS/2 connector 500, both of which have multi-slots.

Currently, there is a new technique specification for monitor, which may make a consumer enjoy clearer picture, and use PC, TV, and projector altogether with less connecting lines. This new specification is called "Displayport", which can make a common cable share audio signals and video signals of good quality, and which has four transmitting channels in total, thus that the data transmitting speed can maximally reach 10.8 GB per second, while its needed channel number is less than that of current cable interface. However, if it is needed to arrange a DisplayPort on a motherboard 100 shown in FIG. 1, it has to sacrifice a connecter or use the supporting body 300 to overlap the DisplayPort over another or other connectors 200*a*, 200*b* due to the limited space in the motherboard 100. This way of arranging the connecting ports of DisplayPort onto the motherboard 100 causes a lot of inconveniences to the motherboard 100 in terms of manufacturing procedure.

Accordingly, aiming to solve aforementioned shortcomings, after a substantially devoted study, in cooperation with the application of relatively academic principles, the inventor has finally proposed the present invention that is designed reasonably to possess the capability to improve the prior arts significantly.

SUMMARY OF THE INVENTION

The invention is mainly to integrate a connecting port of DisplayPort with specific connector on a motherboard in a way, such that after the connection, not only the original connector group is still remained, but also an additional connecting port of DisplayPort is possessed.

The invention is to provide a multi-port connector for integrating the transmission interfaces of DisplayPort and USB, including: a seat body, a DisplayPort, a USB connector, a sealing lid, and a hollow outer shell. At upper portion of the seat body, there is a rabbet, under which a connecting trough is arranged. At back of the seat body, there is a recessing part, at upper portion of which an assembling opening is arranged and communicated to the rabbet. A plurality of fissures are arranged on a wall of the recessing part. The DisplayPort is assembled in the rabbet, while the USB connector is assembled in the connecting trough. The sealing lid is assembled and connected in the recessing part at back of the seat body. The sealing lid includes a wall surface and a bulger extending from an edge of the wall surface. The bulger is received in the assembling opening of the recessing part. On the wall surface of the sealing lid, there are a plurality of striping ribs snapped into the fissures. The hollow outer shell externally fitted to the seat body is arranged a first perforation and a second perforation at front side face thereof. The first and second perforations respectively correspond to a plug-in opening and a USB slot, while a set of assembling-and-connecting legs are extended at a bottom side face of the hollow outer shell.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

In cooperation with attached drawings, the technical contents and detailed description of the present invention are described thereinafter according to a preferable embodiment, being not used to limit its executing scope. Any equivalent variation and modification made according to appended claims is all covered by the claims claimed by the present invention.

Figure 1:
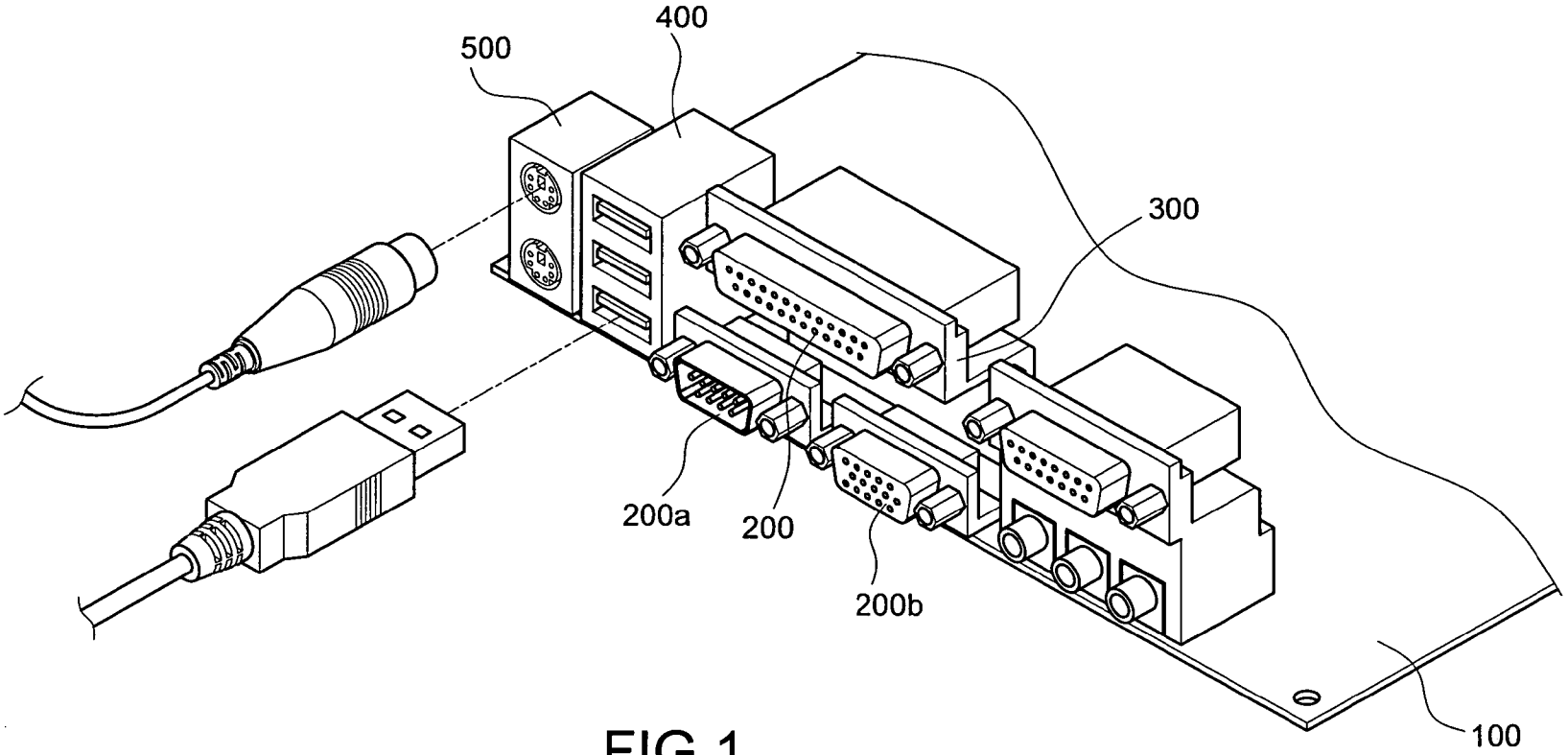
FIG.1 (Prior Art)
FIG. 1 is a perspective illustration of an outer appearance of a traditional motherboard.
Figure 2:
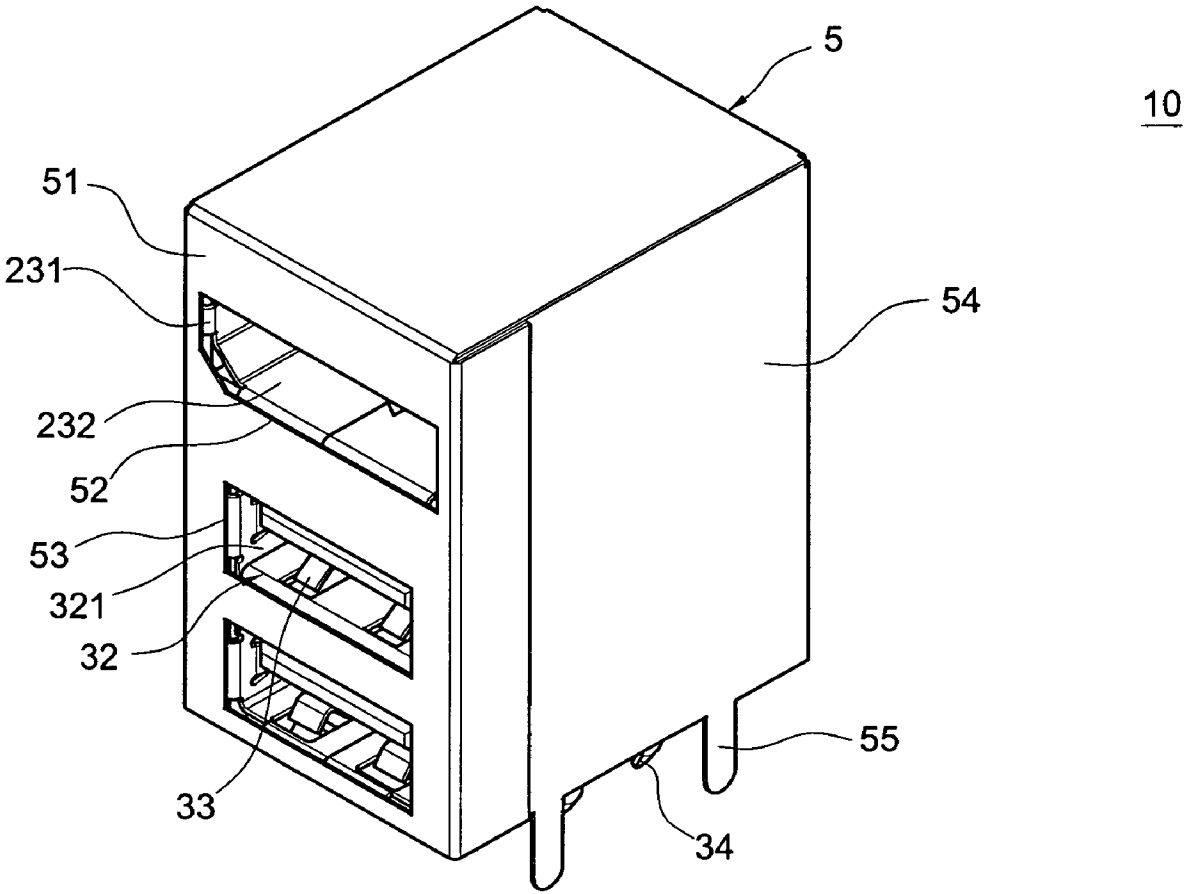
FIG. 2 is a perspective illustration of an outer appearance of a multi-port connector, for DisplayPort and USB connector, according to the present invention.
Figure 3:
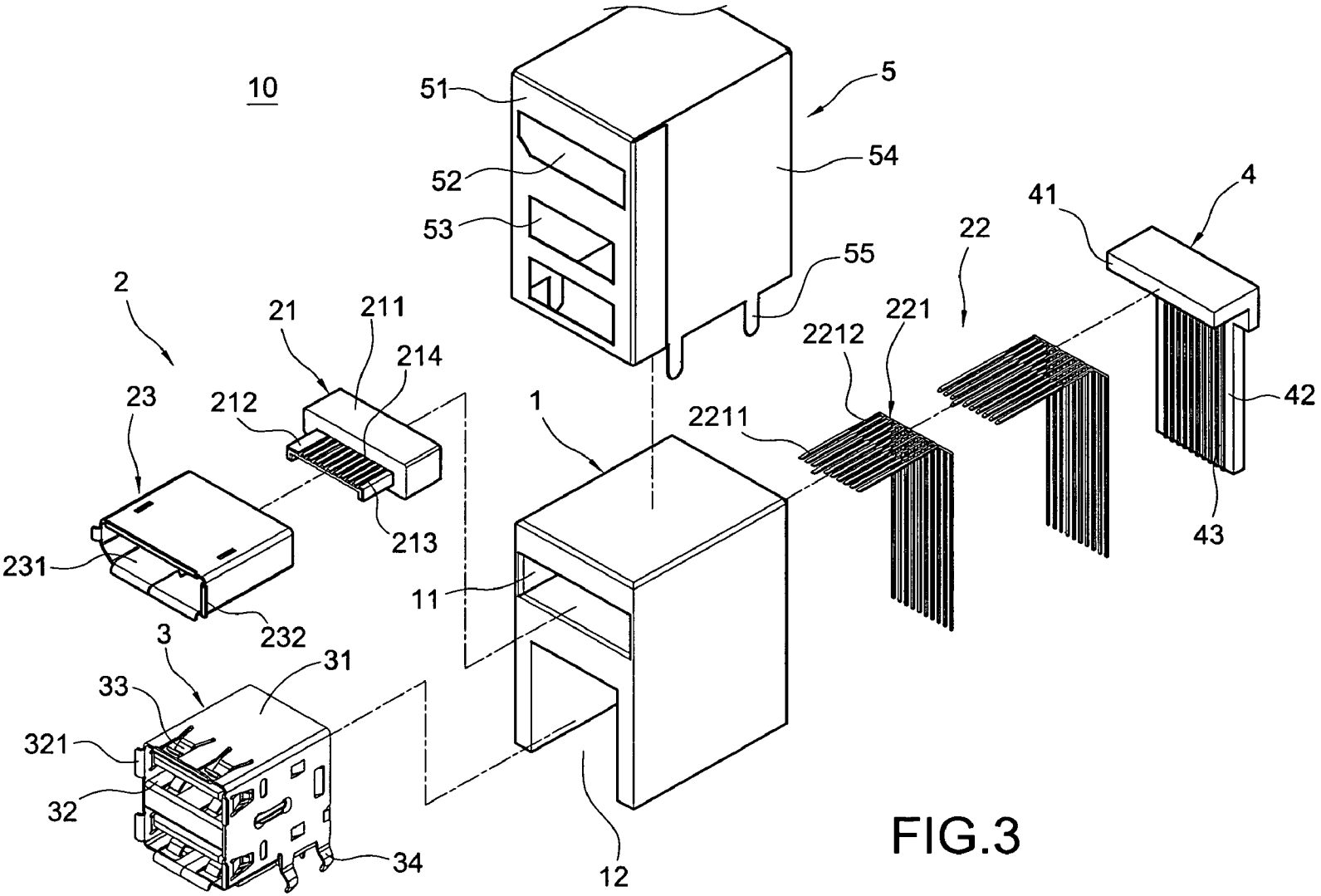
FIG. 3 is an explosive illustration of a multi-port connector, for DisplayPort and USB connector, according to the present invention.
Figure 4:
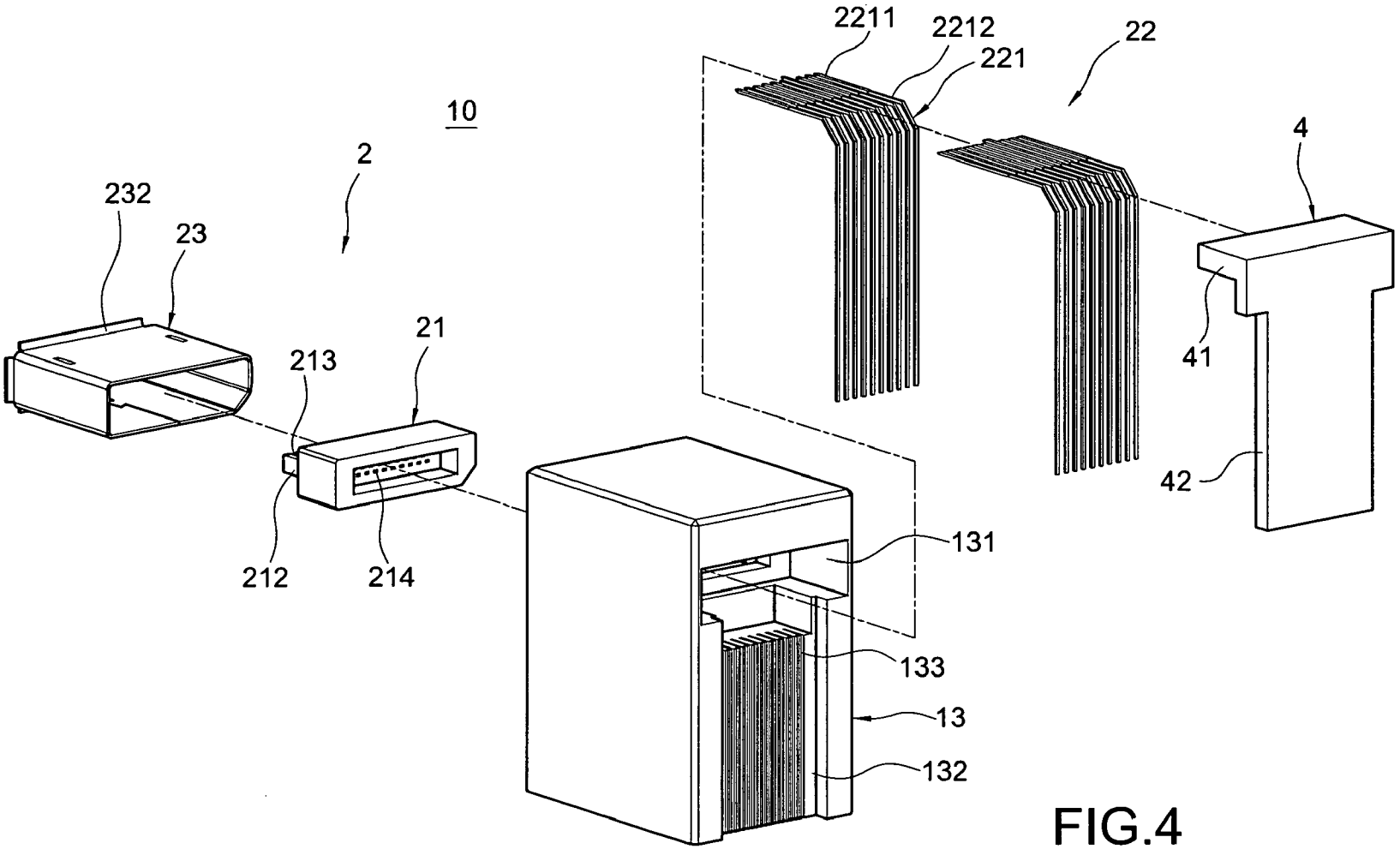
FIG. 4 is an explosive illustration for FIG. 3 viewed from another angle; and, FIG. 5 is an illustration of a multi-port connector, according to the present invention, under a using status.

Please refer to FIG. 2 and FIG. 3, which respectively are a perspective and explosive illustrations of a multi-port connector for DisplayPort and USB connector according to the present invention, and please refer to FIG. 4, which is an explosive illustration for FIG. 3 viewed from another angle. As shown in these figures, a multi-port connector for DisplayPort and USB connector according to the present invention includes: a seat body 1, a DisplayPort 2, a USB connector 3, a sealing lid 4, and a hollow outer shell.

In this preferable embodiment, the seat body 1 is made of electrically insulating materials, on which a rabbet 11 for assembling a DisplayPort 2 is arranged. Under the rabbet 11, there is a "U"-shaped connecting trough 12, by which a USB connector 3 with double slots is arranged. At back of the seat body 1, a "T"-shaped recessing part 13 is arranged, at upper portion of which there is an assembling opening 131 communicated to the rabbet 11. Meanwhile, a plurality of fissures 133 are arranged on a wall surface 132 of the recessing part 13.

In this case, the DisplayPort 2 inserted into the rabbet 11 is constructed by an insulating supporting body 21, a terminal set 22, and a metallic shell 23. At front side of the insulating supporting body 21, a sealing wall 211 is arranged, toward outward direction of which a supporting piece 212 is extended, at front and rear sides of which a plurality of grooves 213 are arranged, at which a plurality of perforations 214 are arranged in corresponding to the sealing wall 211 for providing the terminal set 22 to pass through. The terminal set 22 is composed of a plurality of connecting legs 221, on each which a front connecting leg 2211 is arranged, at back side of which a rear connecting leg 2212 bent into 90 degrees is extended. After the front connecting leg 2211 is being passed through the perforation 214 and fixedly inserted into the groove 213, the rear connecting leg 2212 is embedded into the fissure 133 at back of the seat body 1. At front side of the metallic shell 23, there is a plug-in opening 231, at the circumference of which a plurality of arc catches 232 are supportively connected, which are abutted against the opening circumference of the rabbet 11 of the seat body 1.

Furthermore, the USB connector 3 assembled in the connecting trough 12 of the seat body 1 has a metallic mask 31, on which a plurality of leaf springs 33 are arranged in corresponding to the interior of the USB slot 32. After a plug of a USB transmitting line (not shown in the figure) is plugged into the USB slot 32, the leaf spring 33 then clips the plug tightly to keep it from loosening. In addition, a plurality of arc catches 321 are supportively connected at the circumference of the USB slot 32. Each arc catch 321 is abutted against the trough circumference of the connecting trough 34 of the seat body 1. Again, a set of connecting legs 34 are extended under the metallic mask 31 and are capable of being fixedly connected to a motherboard (not shown in the figure).

In this preferable embodiment, with a bulger 41 arranged thereon, the sealing lid 4 is assembled and connected at back of the seat body 1. When the sealing lid 4 has been assembled and connected into the assembling opening 131 of the recessing part 13 at back of the seat body 1, a plurality of striping ribs 43 arranged on the wall surface 42 of the sealing lid 4 are snapped into the fissures 133, making the striping ribs 43 abutted against the rear connecting legs 2212 of the terminal set 22.

In this case, the hollow outer shell 5 made of metallic materials is fitted externally to the seat body 1 by arranging a first perforation 52 and a second perforation 53 at a front side thereof for the plugs of DisplayPort and USB to pass through. A set of connecting legs 55 extended at bottom of a side face 54 of the hollow outer shell 5 are fixedly connected with a motherboard. When the plugs of DisplayPort and USB are being pulled out or plugged in, it won't create a shaking phenomenon to the multi-port connector, so it is very easy for a user to pull out or plug in a plug of DisplayPort or USB.

Figure 5:
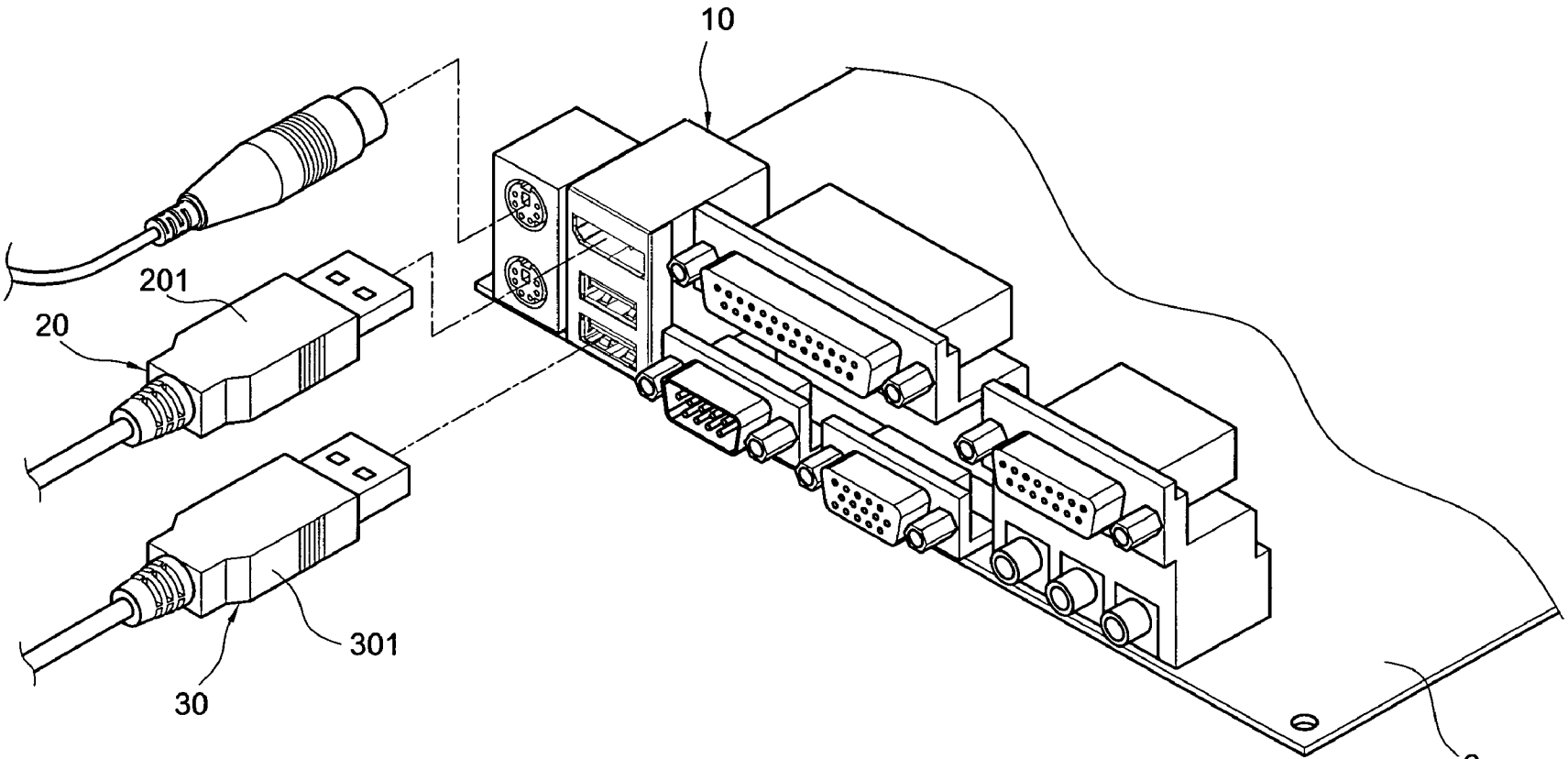

Please refer to FIG. 5, which is an illustration of a multi-port connector according to the present invention under a using status. As shown in this figure, when the multi-port connector 10 is electrically connected to a computer's motherboard 6, the multi-port connector 10 is fixedly arranged to the computer's motherboard 6. When the user needs to make a multimedia audio-and-video signals' transmission, he only has to plug the DisplayPort plug 201 of the DisplayPort transmission line 20 into the slot 231 of the multi-port connector 10, thereby an image signal being able to be transmitted by the user.

When the user needs to make a data accession, he only has to plug the USB plug 301 of a USB transmitting line 30 of a mobile device (not shown in the figure) into the USB slot 32, thereby the data stored in the mobile device being able to be transmitted into the computer, and vice versa.

Summarizing aforementioned description, the invention is an indispensable product of novelty indeed, which may positively reach the expected usage objective for solving the drawbacks of the prior arts, and which extremely possesses the innovation and progressiveness for completely fulfilling the applying merits of new type patent, according to which the invention is thereby applied. Please examine the application carefully and grant it as a formal patent for protecting the rights of the inventor.

However, the aforementioned description is only a preferable embodiment according to the present invention, being not used to limit the patent scope of the invention, so equivalently structural variation made to the contents of the present invention, for example, description and drawings, is all covered by the claims claimed thereinafter.

What is claimed is:

1. A multi-port connector for integrating transmission interfaces of DisplayPort and USB, comprising:

a seat body, at an upper portion of which a rabbet is arranged, under the rabbet there being a connecting trough, the seat body including a recessing part arranged at back thereof, the recessing part being configured as a "T" shape, an upper portion of the recessing part having an assembling opening communicated to the rabbet, and a plurality of fissures being arranged on a wall surface of the recessing part;

a DisplayPort being connected into the rabbet, wherein the DisplayPort is comprised of an insulating supporting body, a terminal set, and a metallic shell, the metallic shell is received in the rabbet, and the insulating supporting body is received in the metallic shell, a front side of the insulating supporting body being arranged a sealing wall which is extended outwardly a supporting piece, on a front side and a rear side of the supporting piece a plurality of grooves being arranged, and at the grooves a plurality of perforations being arranged in corresponding to the sealing wall for providing the terminal set to pass through;

a USB connector being connected into the connecting trough, and a substantially L-shaped sealing lid assembled in the recessing part at back of the seat body; wherein the sealing lid comprises a wall surface and a bulger extending from an upper edge of the wall surface, the bulger being received in the assembling opening of the recessing part; and a plurality of striping ribs being arranged on the wall surface and being snapped into the fissures.

2. The multi-port connector for integrating transmission interfaces of DisplayPort and USB according to claim 1, wherein the seat body is made of an insulating material.

3. The multi-port connector for integrating transmission interfaces of DisplayPort and USB according to claim 1, wherein the connecting trough is configured as a "U" shape.

4. The multi-port connector for integrating transmission interfaces of DisplayPort and USB according to claim 1, wherein the terminal set is comprised of a plurality of connecting legs, at each connecting leg a front connecting leg is arranged, at rear side of each connecting leg a rear connecting leg bent into 90 degrees is arranged, the front connecting leg being fixed in the slot after passing through the perforation, meanwhile, the rear connecting leg being embedded into the fissure at back of the seat body.

5. The multi-port connector for integrating transmission interfaces of DisplayPort and USB according to claim 1, wherein a plug-in opening is arranged at front of the metallic shell, and a plurality of arc catches is supportively connected at a circumferential of the plug-in opening and abutted against a circumference of the rabbet of the seat body.

6. The multi-port connector for integrating transmission interfaces of DisplayPort and USB according to claim 1, wherein the USB connector has a metallic mask and a plurality of USB slots, a plurality of leaf springs being arranged at the metallic mask in corresponding to an interior of the USB slot, in addition, a plurality of arc catches being supportively connected at a circumference of the USB slot and abutted against a circumference of the connecting trough of the seat body, meanwhile, a set of connecting legs being extended under the metallic mask.

7. The multi-port connector for integrating transmission interfaces of DisplayPort and USB according to claim 1, further including a hollow outer shell externally fitted to the seat; a first perforation and a second perforation respectively arranged at a front side of the hollow outer shell in corresponding to the plug-in opening and the USB slot;

and a set of connecting legs arranged at a bottom side face of the hollow outer shell.

8. The multi-port connector for integrating transmission interfaces of DisplayPort and USB according to claim 7, wherein the hollow outer shell is made of a metallic material.

9. A multi-port connector for integrating transmission interfaces of DisplayPort and USB, comprising:

a seat body, at an upper portion of which a rabbet is arranged, under the rabbet there being a connecting trough, the seat body including a recessing part arranged at back thereof, the recessing part being configured as a "T" shape, an upper portion of the recessing part having an assembling opening communicated to the rabbet, and a plurality of fissures being arranged on a wall surface of the recessing part;

a DisplayPort being connected into the rabbet, wherein the DisplayPort is comprised of an insulating supporting body, a terminal set, and a metallic shell, the metallic shell is received in the rabbet, and the insulating supporting body is detachably received in the metallic shell;

a USB connector being connected into the connecting trough, and a substantially L-shaped sealing lid assembled in the recessing part at back of the seat body; wherein the sealing lid comprises a wall surface and a bulger extending from an upper edge of the wall surface, the bulger being received in the assembling opening of the recessing part; and a plurality of striping ribs being arranged on the wall surface and being snapped into the fissures.

* * * * *